US008607483B2

(12) United States Patent
Tahincioglu

(10) Patent No.: US 8,607,483 B2
(45) Date of Patent: Dec. 17, 2013

(54) IRON WITH EXTERNAL WATER RESERVOIR

(76) Inventor: Besim Tahincioglu, Gebze (TR)

( * ) Notice: Subject to any disclaimer, the term of this patent is extended or adjusted under 35 U.S.C. 154(b) by 95 days.

(21) Appl. No.: 13/265,932

(22) PCT Filed: Apr. 22, 2010

(86) PCT No.: PCT/EP2010/055403
§ 371 (c)(1),
(2), (4) Date: Oct. 24, 2011

(87) PCT Pub. No.: WO2010/122131
PCT Pub. Date: Oct. 28, 2010

(65) Prior Publication Data
US 2012/0036744 A1 Feb. 16, 2012

(30) Foreign Application Priority Data
Apr. 22, 2009 (EP) ..... 09158511

(51) Int. Cl.
*D06F 75/24* (2006.01)
*D06F 75/12* (2006.01)

(52) U.S. Cl.
USPC ..... 38/77.83; 38/79

(58) Field of Classification Search
USPC ..... 38/74–77.83, 79
See application file for complete search history.

(56) References Cited

U.S. PATENT DOCUMENTS

| | | | | | |
|---|---|---|---|---|---|
| 4,535,556 | A * | 8/1985 | Cavalli | 38/77.6 |
| 5,428,910 | A * | 7/1995 | Gudefin et al. | 38/77.6 |
| 5,430,963 | A * | 7/1995 | Kuo-Chu | 38/77.6 |
| 5,842,295 | A * | 12/1998 | Ching et al. | 38/77.6 |
| 6,061,935 | A * | 5/2000 | Lee | 38/77.6 |
| 2010/0011629 | A1 * | 1/2010 | Pieters et al. | 38/77.6 |

FOREIGN PATENT DOCUMENTS

GB 1997291897 * 6/1997

* cited by examiner

*Primary Examiner* — Ismael Izaguirre
(74) *Attorney, Agent, or Firm* — Epstein Drangel LLP; Robert L. Epstein

(57) ABSTRACT

The present invention proposes a domestic appliance and specifically an ironing appliance having an external water reservoir connected to the appliance through a feeding tube. Water conveyed to the ironing unit is directly subjected to an independently heated inner plate where steam is directly produced and conveyed to the soleplate whose temperature being independently adjusted. The independently heated inner plate comprises a pair of covers set one above the other. The first cover receives water through its openings and channels and the second cover lying just below the first one to define an inner space allows conveyance of the water to the steam producing plate. The steam then reaches the soleplate to be applied to the cloth item being ironed.

12 Claims, 5 Drawing Sheets

IRON WITH EXTERNAL WATER RESERVOIR

TECHNICAL FIELD OF THE INVENTION

The present invention relates to an ironing unit having a separate water reservoir and an additional inner plate for massive production of steam without having an adverse effect on the temperature stability of iron sole plate.

BACKGROUND OF THE INVENTION

There are a variety of ironing appliances with external reservoirs in the prior art. Irons with external reservoir units are advantageous in that they provide sufficient steam in terms of both quantity and pressure. A common problem with ironing appliances is the inadequacy of steam in terms of stability and availability in the course of ironing as well as pressure of the same. To overcome this, a common approach is to employ an external steam production unit which is pressurized independently as in industrial ironing appliances. Potential drawback of an ironing appliance with such an external steam generator is that the steam reservoir usually takes up to 5 to 6 times more time than the sole plate to be heated up to an adequate level. Another drawback is the necessity to wait until the reservoir cools down prior to refilling the same. Further, it is known that such reservoirs are bulky and are not suitable for home use.

The present invention employs an external water reservoir to produce steady steam in desired quantities such that it does not require pressurization in the external reservoir for the steam production as the steam is not produced within the reservoir.

The present invention proposes an improved system in which water is first conveyed to an upper soleplate from which it is distributed by a plurality of locations to the lower soleplate, during which distribution conversion into steam phase occurs before contacting the lower soleplate. The steam therefore produced and conveyed to the lower soleplate is independent of the temperature of the lower soleplate or heat accumulated therein.

FR 2853671 also suggests an ironing appliance having an external water reservoir from which water is pumped to an evaporation chamber within the ironing appliance. This approach involves storage of vapor in a pressurized state and conveyance to the soleplate thereof as much as needed. The present invention on the other hand provides the simple effect that steam is not stored or is not stayed for pressurization and is produced directly before reaching the soleplate by means of an additional inner plate. The present invention therefore suggests a far more efficient steam production system as only a desired amount of water is conveyed from the external water reservoir to be directly transformed into steam and consumed without being stored or pressurized to a certain extent. Production of steam is triggered as much as the users demands and without consuming the heat accumulated in the sole plate, hence in the absence of adverse effects to the temperature stability of the sole plate. The external reservoir can be refilled during ironing since it is not pressurized. Further it is not required that the internal steam chamber is regularly monitored to restore diminished water. Due to the fact that an ironing appliance having an external reservoir which can be refilled during ironing requires an additional reservoir with a pump for conveying water to steam generator is the most prominent disadvantage in terms of heightening end user price of the product. The present invention overcomes all the above drawbacks with an iron refillable during ironing with an economically reasonable price.

A prominent prior art reference to the subject matter of claim 1 is disclosed in U.S. Pat. No. 3,263,350. Said document discloses an ironing apparatus comprising a soleplate for ironing a cloth item, a water reservoir for supplying water to be transformed into steam and a heatable inner plate for transforming water conveyed from said external water reservoir into steam.

OBJECTS OF THE INVENTION

One of the objects of the present invention is to provide an ironing appliance having an improved steam capacity, the steam being produced independently from the heat supply to the soleplate.

Another object of the present invention is to provide an ironing appliance having a soleplate whose temperature is not changed by the steam production process, the temperature being independently adjusted as best suits to the cloth type being ironed.

Another object of the present invention is to provide an ironing appliance in which desired amount of steam is directly produced and instantly consumed without being accumulated or pressurized, therefore providing a more efficient instant steam production system. This is further advantageous in the fact that the iron can be made less heavy as it does no longer need to have a container for storing or pressurizing steam.

Another object of the present invention is to provide an ironing appliance in which steam production is effected such that only desired amount of water is conveyed from the external water reservoir to be instantly transformed into steam and consumed without being stored or pressurized to a certain extent.

SUMMARY OF THE INVENTION

The present invention proposes a domestic appliance and specifically an ironing appliance having an external water reservoir connected to the appliance through a feeding tube. Water conveyed to the ironing unit is directly subjected to an independently heated inner plate where steam is directly produced and conveyed to the soleplate whose temperature being independently adjusted. The independently heated inner plate comprises a pair of covers set one above the other. The first cover receives water through its openings and channels and the second cover lying just below the first one to define an inner space allows conveyance of the water to the steam producing plate. Phase conversion occurs instantly in the meanwhile. The steam then reaches the soleplate to be applied to the cloth item being ironed. Temperature of the sole plate can be kept constant and—for certain fabric types such as silk—at surprising low levels where no steam production may practically occur.

BRIEF DESCRIPTION OF THE FIGURES

Accompanying drawings are given solely for the purpose of exemplifying an iron, whose advantages over prior art were outlined above and will be explained in detail hereinafter.

DETAILED DESCRIPTION OF THE INVENTION

Figure 1:
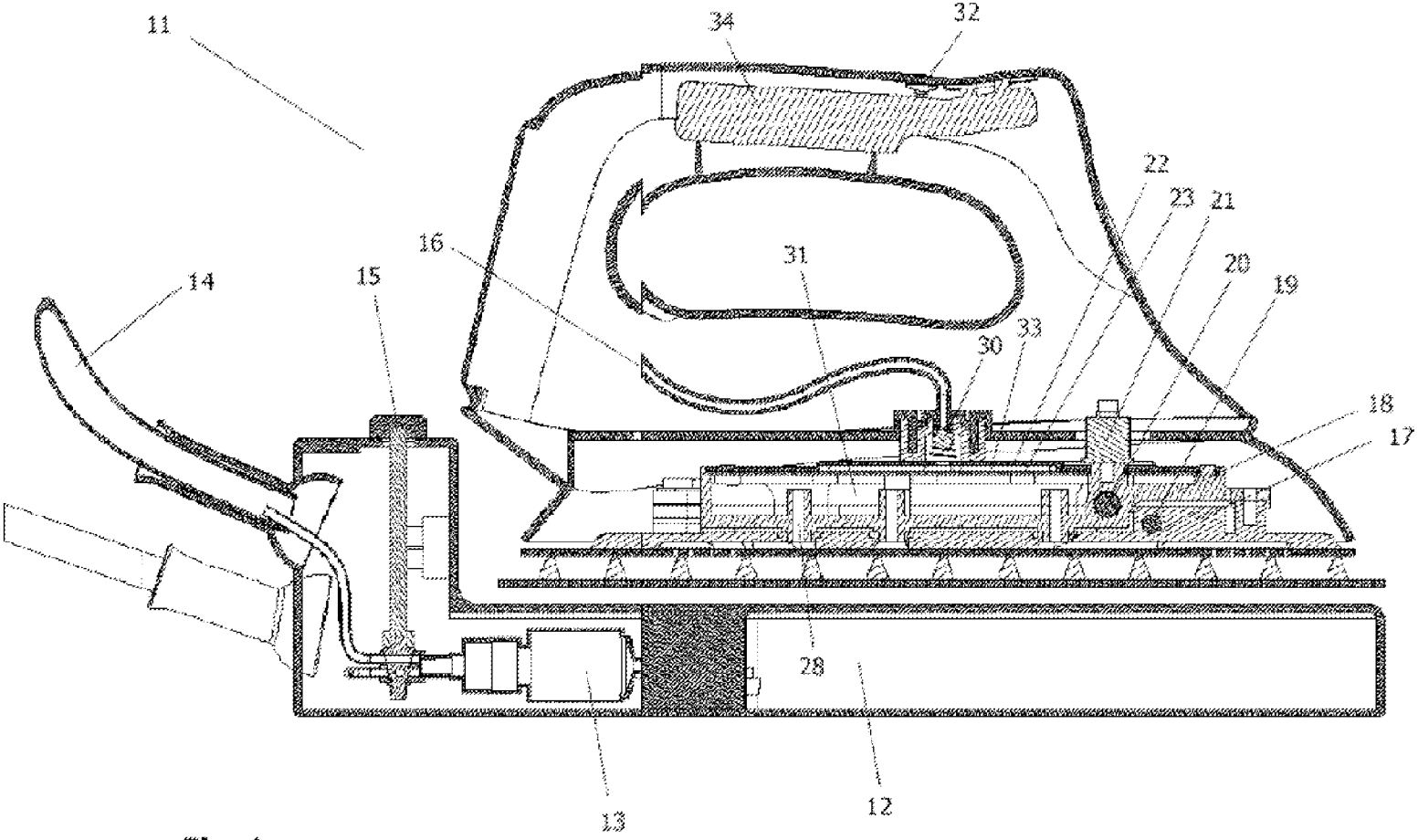
FIG. 1 demonstrates a cross-sectional side view of an ironing appliance according to the present invention.

Referring now to the figures outlined above, the present invention proposes an ironing apparatus (11) having an external water reservoir (12) where water is contained at room temperature and atmospheric pressure. The water is pumped to the ironing appliance (11) by a pump (13) through a supply tube (14). A steam adjusting button (15) is typically used to adjust the amount of water to be conveyed to the ironing appliance. Amount of water to be conveyed can be changed by adjusting pump (13) speed or through conventional mechanical means. Water pumped to the ironing appliance (11) is supplied by a feed tube (16) in the ironing appliance (11). The feed tube conveys water in liquid phase at room temperature.

According to the present invention, in addition to the regular soleplate (17), a heated inner plate (18) is provided in order for transforming water pumped from the external water reservoir (12) directly into steam by way of physical contact. The inner plate (18) and the soleplate (17), having minimum physical contact with each other to avoid a closed thermal circuit, are independently heated by respective heating means (20, 19) in the form of electrical resistances. A thermostat (21) is utilized to regulate said inner plate's (18) temperature as long as steam consumption is continued. The inner plate (18) being partially in direct thermal communication with the soleplate (17) and said soleplate's (17) temperature being independently set provides that ironing special cloth items of different fabric properties is possible. It should be noted that silk items for example require a very low ironing temperature, where vaporization of water could not be expected if it would take place at a conventional single soleplate. An electronic chip (34) may conventionally enable control of various physical parameters according to the present invention.

Figure 2A:
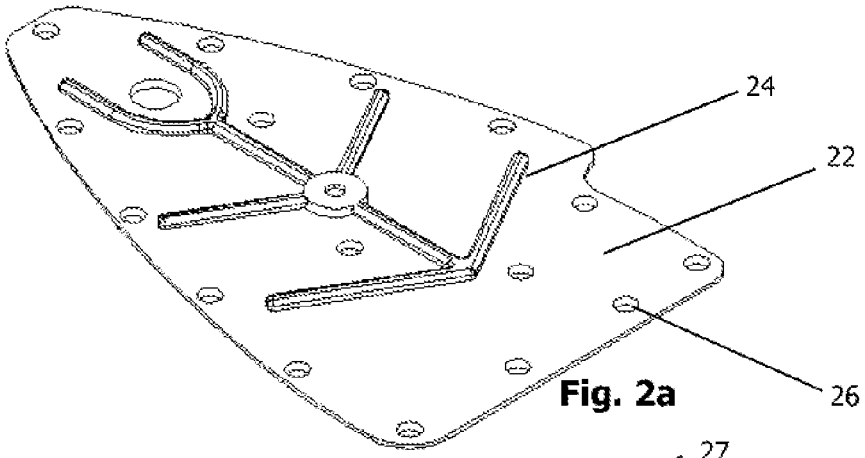
FIG. 2*a* demonstrates the upper cover of the inner plate of the ironing appliance according to the present invention.
Figure 2B:
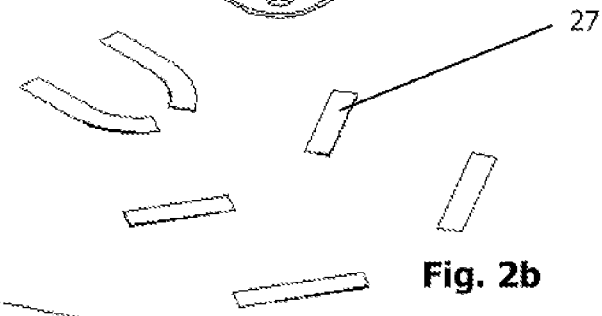
FIG. 2*b* demonstrates the filtering means in between the upper and lower covers according to the present invention.
Figure 2C:
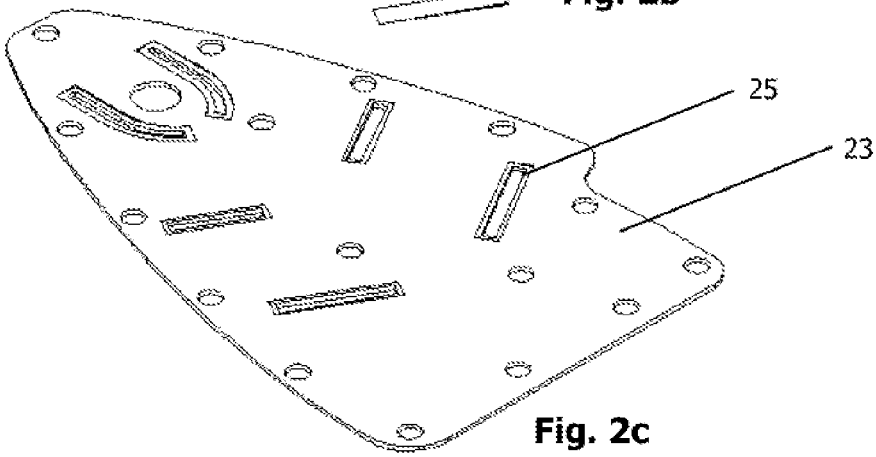
FIG. 2*c* demonstrates the lower cover of the inner plate of the ironing appliance according to the present invention.

Water pumped from the external water reservoir (12) is received by a pair of covers (22 and 23) set one above the other. The first cover or the upper cover (22) receives water through its channels (24) and the second cover (23) lying right below the first one in the manner to define an inner space (33) allows conveyance of the water to the steam producing plate (18). FIG. 2 demonstrates the covers (22 and 23) in detail. The upper cover is comprised of a plurality of water pathways (24) in the form of a tree branch formation, the pathways being in fluid communication with each other. The lower cover (23) on top of the inner plate (18) on the other hand, comprises corresponding facing channel arms (25) partially covering said tree branch formation at the edge portions thereof. Both covers (22, 23) are riveted to the upper plate (18) through a plurality of riveting holes (26) around said covers (22, 23).

According to the present invention, steam is instantly produced when water contacts the upper or inner plate 18. This latter receives water through filtering means (27) placed inside the channels arms (25). Said filtering means (27) in the form of wire mesh provide the effects of both distributing and spraying water into a plurality of small parts.

Figure 3:
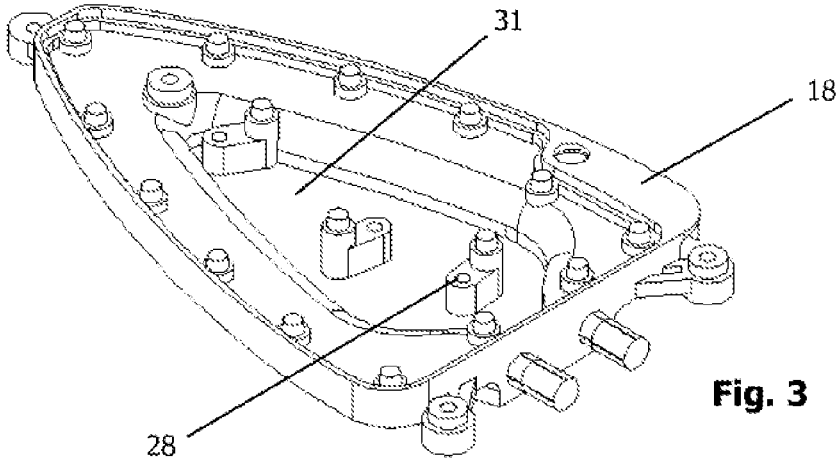
FIG. 3 demonstrates the upper or inner plate of the ironing appliance according to the present invention.
Figure 4:
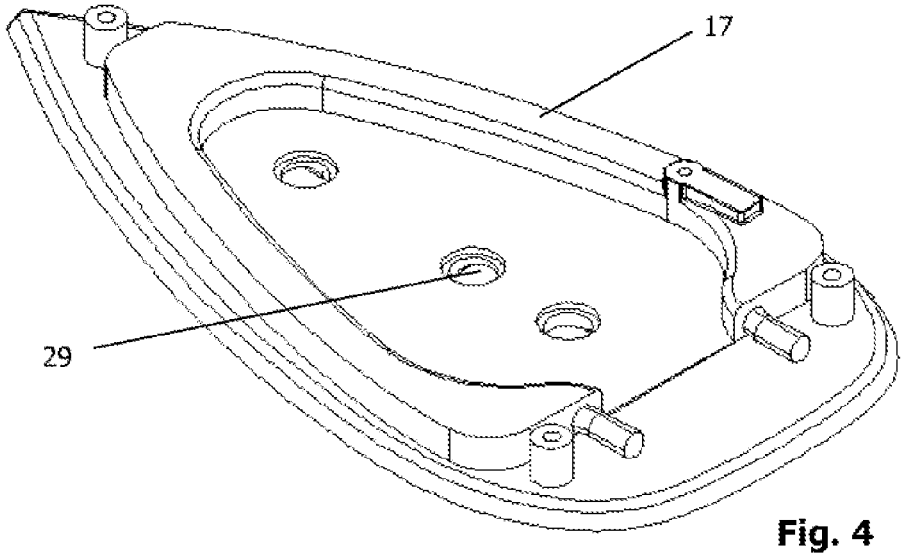
FIG. 4 demonstrates the soleplate of the ironing appliance according to the present invention.

FIG. 3 demonstrates the upper or inner plate (18) of the ironing appliance (11) according to the present invention. Steam is produced by direct contact of water to said upper plate (18) and instantly passed through in an inner space (31) delimited by said upper plate (18). Produced steam is conveyed to the soleplate (17) through a plurality of steaming channels (28) of said upper or inner plate (18). Said soleplate (18) having corresponding steaming vents (29) therethrough provide steam. Although the upper plate (18) is expected to cool down very quickly during steam consumption in response to direct contact of water thereto, large temperature differences on said inner plate (18) will not affect the temperature of the sole plate in contact with the cloth item being ironed according to the present invention. The two plates (17, 18) have separate heating means (19, 20) and their temperatures are independently controlled. The soleplate's (17) temperature can be set by a respective button (32).

A one-way spring ball valve (30) ensures that steam produced in the inner space (31) delimited by said upper plate (18) does not return to the reservoir (12).

In a nutshell, the present invention proposes an ironing apparatus (11) comprising a soleplate (17) for ironing a cloth item, an external water reservoir (12) for storing and supplying water to said ironing apparatus (11) to be transformed into steam for instant use during ironing and a heatable inner plate (18) within said ironing apparatus (11) for transforming water conveyed from said external water reservoir (12) directly into steam by way of physical contact. Said heatable inner plate (18) extends over the entire space of said soleplate (17) and is not in direct thermal communication with the same. In this way, only desired amount of water is conveyed from said external water reservoir (12) to be directly transformed into steam and consumed without being stored.

Further, said inner plate (18) comprises a pair of covers (22 and 23) on top thereof set one above the other for receiving water conveyed from said water reservoir (12). The first cover (22) comprises openings (24) for allowing passage of water into the second cover (23) and said second cover (23) comprises smaller openings (25) in alignment with said openings (24) of said first cover (22), the latter openings (25) being filled by filtering means for pulverizing water into particles.

The external reservoir (12) according to the present invention can be designed to be in an easily refillable fashion, for instance easily releasable to be filled with tap water.

Figure 5:
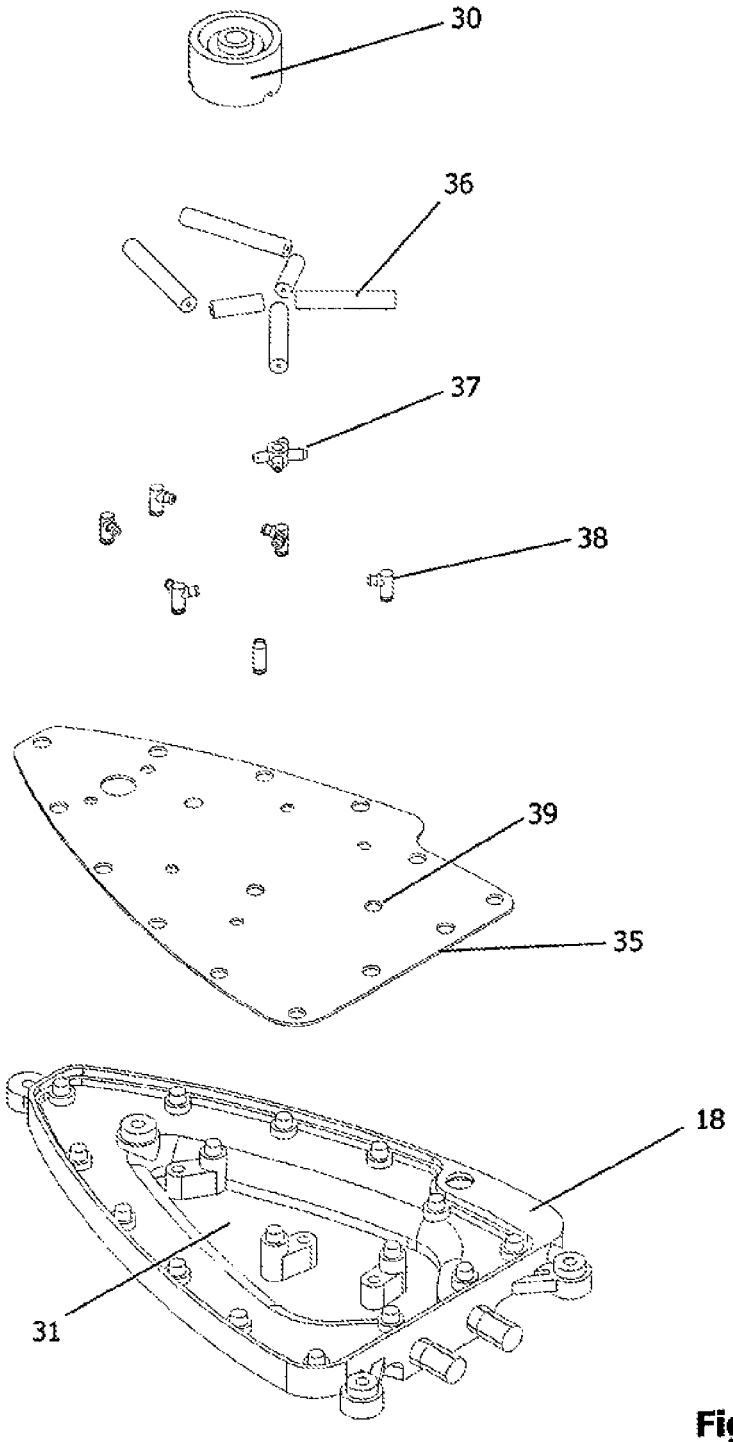
FIG. 5 demonstrates an alternative embodiment of the cover of the upper plate according to the present invention.
Figure 6:
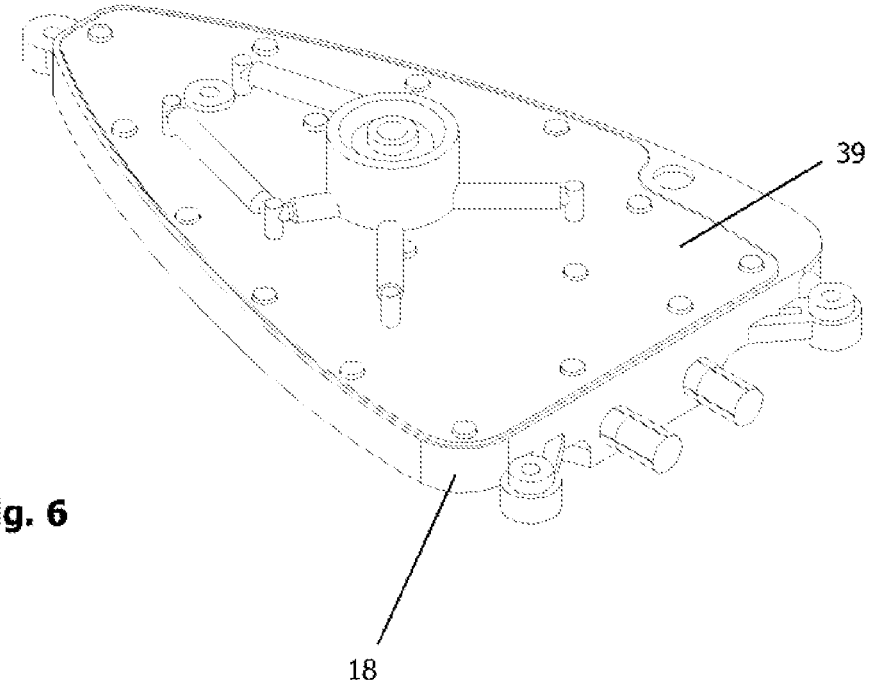
FIG. 6 demonstrates the alternative embodiment of the cover of the upper plate in assembled form according to the present invention.

The present invention also provides an alternative embodiment in which said upper plate (18)'s cover (35) is designed in a singular form. In this configuration (FIG. 5), water is conveyed to said inner space (31) from said one-way spring ball valve (30) by means of said cover (35) having a plurality of holes (39) in connection with diffusers (38). Each diffuser (38) is connected to a distributor (37) directly associated with said one-way spring ball valve (30) through pipe segments (39). Diffusers (38) are widely used in ironing appliances and are therefore known to the skilled man in the art.

Said inner plate (18) defines a closed inner space (31) delimited by said inner plate (18) from below and on the sides and by a cover (23, 35) from above. Said inner plate (18) is partially in direct thermal communication with said soleplate (17) through a plurality of steaming channels (28) opening into a plurality of corresponding vents (29) on said soleplate (17). Said steaming channels (28) extend only partially along the longest line between said inner plate (18) and said cover (23, 35) within said closed inner space (31). Said steaming channels (28) therefore opens to a plane within said inner space (31).

The invention claimed is:

1. An ironing apparatus (11) comprising a soleplate (17) for ironing a cloth item, an external water reservoir (12) for storing and supplying water to said ironing apparatus (11) to be transformed into steam for use during ironing and a heatable inner plate (18) within said ironing apparatus (11) for transforming water conveyed from said external water reservoir (12) directly into steam by way of physical contact wherein said heatable inner plate (18) extends over the entire space of said soleplate (17) and is partially in direct thermal communication with said soleplate (17) whereby only desired amount of water is conveyed from said external water reservoir (12) to be directly transformed into steam and consumed without being stored, wherein said soleplate (17) and said inner plate (18) are independently heated by respective heating means (19, 20).

2. An ironing apparatus (11) as in claim 1 wherein said inner plate (18) defines a closed inner space (31) delimited by said inner plate (18) from below and on the sides and by a cover (23, 35) from above.

3. An ironing apparatus (11) as in claim 1 wherein said inner plate (18) defines a closed inner space (31) delimited by said inner plate (18) from below and on the sides and by a cover (23, 35) from above.

4. An ironing apparatus (11) comprising a soleplate (17) for ironing a cloth item, an external water reservoir (12) for storing and supplying water to said ironing apparatus (11) to be transformed into steam for use during ironing and a heatable inner plate (18) within said ironing apparatus (11) for transforming water conveyed from said external water reservoir (12) directly into steam by way of physical contact wherein said heatable inner plate (18) extends over the entire space of said soleplate (17) and is partially in direct thermal communication with said soleplate (17) whereby only desired amount of water is conveyed from said external water reservoir (12) to be directly transformed into steam and consumed without being stored, wherein said inner plate (18) defines a closed inner space (31) delimited by said inner plate (18) from below and on the sides and by a cover (23, 35) from above, wherein said inner plate's (18) cover (35) for receiving water conveyed from said water reservoir (12) has a plurality of holes (39) in connection with diffusers (38), the latter being connected to a distributor (37) through pipe segments (39).

5. An ironing apparatus (11) comprising a soleplate (17) for ironing a cloth item, an external water reservoir (12) for storing and supplying water to said ironing apparatus (11) to be transformed into steam for use during ironing and a heatable inner plate (18) within said ironing apparatus (11) for transforming water conveyed from said external water reservoir (12) directly into steam by way of physical contact wherein said heatable inner plate (18) extends over the entire space of said soleplate (17) and is partially in direct thermal communication with said soleplate (17) whereby only desired amount of water is conveyed from said external water reservoir (12) to be directly transformed into steam and consumed without being stored, wherein said inner plate (18) defines a closed inner space (31) delimited by said inner plate (18) from below and on the sides and by a cover (23, 35) from above, wherein said inner plate (18) comprises a pair of covers (22 and 23) for receiving water conveyed from said water reservoir (12), first cover (22) comprising openings (24) for allowing passage of water into the second cover (23) and said second cover (23) comprising smaller openings (25) in alignment with said openings (24) of said first cover (22), the latter openings (25) being filled by filtering means in the form of wire mesh for pulverizing water into particles.

6. An ironing apparatus (11) as in claim 5 wherein said openings (24) of said first cover (22) consist of a plurality of water pathways (24) in the form of a tree branch formation and said openings (25) of said second cover (23) consist of channel arms (25) partially covering said tree branch formation at the edge portions thereof.

7. An ironing apparatus (11) as in claim 4 wherein said inner plate (18) is partially in direct thermal communication with said soleplate (17) through a plurality of steaming channels (28) opening into a plurality of corresponding vents (29) on said soleplate (17).

8. An ironing apparatus (11) as in claim 6 wherein said inner plate (18) is partially in direct thermal communication with said soleplate (17) through a plurality of steaming channels (28) opening into a plurality of corresponding vents (29) on said soleplate (17).

9. An ironing apparatus (11) as in claim 8 wherein said steaming channels (28) extend only partially along the longest line between said inner plate (18) and said cover (23, 35) within said closed inner space (31).

10. An ironing apparatus (11) as in claim 1 wherein said inner plate's (18) temperature is regulated by a thermostat (21).

11. An ironing apparatus (11) as in claim 1 wherein said soleplate's (17) temperature is settable by a respective button (32).

12. An ironing apparatus (11) comprising a soleplate (17) for ironing a cloth item, an external water reservoir (12) for storing and supplying water to said ironing apparatus (11) to be transformed into steam for use during ironing and a heatable inner plate (18) within said ironing apparatus (11) for transforming water conveyed from said external water reservoir (12) directly into steam by way of physical contact wherein said heatable inner plate (18) extends over the entire space of said soleplate (17) and is partially in direct thermal communication with said soleplate (17) whereby only desired amount of water is conveyed from said external water reservoir (12) to be directly transformed into steam and consumed without being stored, wherein a one-way spring ball valve (30) is used to prevent escape of produced steam from an inner space (31) delimited by said upper plate (18) in the direction of said reservoir (12).

* * * * *